US011759973B2

(12) United States Patent
Johnson

(10) Patent No.: US 11,759,973 B2
(45) Date of Patent: Sep. 19, 2023

(54) PALLET FORMING CONCRETE MOLD ASSEMBLY

(71) Applicant: Rod Johnson, Duluth, MN (US)

(72) Inventor: Rod Johnson, Duluth, MN (US)

( * ) Notice: Subject to any disclaimer, the term of this patent is extended or adjusted under 35 U.S.C. 154(b) by 679 days.

(21) Appl. No.: 16/844,025

(22) Filed: Apr. 9, 2020

(65) Prior Publication Data

US 2021/0316474 A1 Oct. 14, 2021

(51) Int. Cl.
*B28B 7/00* (2006.01)
*B65D 19/00* (2006.01)

(52) U.S. Cl.
CPC ..... *B28B 7/0079* (2013.01); *B65D 19/0018* (2013.01); *B65D 2519/00039* (2013.01); *B65D 2519/00074* (2013.01); *B65D 2519/00268* (2013.01); *B65D 2519/00288* (2013.01); *B65D 2519/00338* (2013.01)

(58) Field of Classification Search
CPC ... B28B 7/0079; B28B 7/0055; B28B 7/0082; B65D 19/0038
See application file for complete search history.

(56) References Cited

U.S. PATENT DOCUMENTS 5,402,609 A * 4/1995 Kelley, Jr. ..... E04B 2/32 52/561
5,725,041 A * 3/1998 Schultz ..... B22D 15/04 164/262
2002/0090409 A1* 7/2002 Seger ..... B29C 33/305 249/102
2004/0179896 A1 9/2004 Curry
2005/0152744 A1 7/2005 Straub
2005/0193929 A1* 9/2005 Ingham ..... B29C 66/114 108/56.3
2016/0368659 A1* 12/2016 Bastian, II ..... B29C 39/18
2019/0031393 A1* 1/2019 El Kawam ..... B65D 19/0018

FOREIGN PATENT DOCUMENTS

| | | | |
|---|---|---|---|
| CN | 201972295 | | 1/2011 |
| GB | 1060581 | A * | 3/1967 |
| JP | 2001038322 | | 7/1999 |
| JP | 4037201 | | 7/2007 |
| KR | 970058864 | | 5/1997 |
| KR | 20020006262 | | 7/2000 |
| KR | 10661627 | | 3/2006 |
| KR | 20140058021 | | 11/2012 |

OTHER PUBLICATIONS

Stratis Pallet P4834LRS00 (Year: 2014).*

* cited by examiner

*Primary Examiner* — Kelly M Gambetta
*Assistant Examiner* — Virak Nguon

(57) ABSTRACT

A pallet forming concrete mold assembly includes a bottom wall having a top side, a bottom side and a perimeter edge. The perimeter wall has a rectangular shape and the bottom wall has a length and width each is between 40.0 inches and 60.0 inches. A perimeter wall is attached to and extends upwardly from the perimeter edge. The perimeter wall includes a front wall, a rear wall, a first lateral wall and a second lateral wall. The top side of the bottom wall has a pair of raised sections extending from the front wall to the back wall. The raised sections form forklift slots in a concrete block formed by the bottom and perimeter walls. The raised sections are oriented parallel to each other.

11 Claims, 6 Drawing Sheets

PALLET FORMING CONCRETE MOLD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to waste concrete mold form and more particularly pertains to a new waste concrete mold form for utilizing waste concrete to form concrete pallets. The pallets may thereafter be utilized in a conventional manner for storing and transporting articles. Moreover, as the pallets are comprised of concrete, they are not subject to weathering as would be traditional wood pallets and can therefore be utilized outside to space articles to be stored off of the ground.

(2) Description of Related Art Including Information Disclosed Under 37 CFR 1.97 and 1.98

The prior art relates to waste concrete mold forms that are configured to receive concrete to form concrete blocks. More specifically, some forms are suited for receiving large amounts of waste concrete to form large blocks that can be used as barriers and retaining wall functions. However, these blocks are otherwise not useful and a new use for waste concrete is needed as nearly all concrete pouring tasks have an amount of concrete leftover, which cannot be utilized, and therefore is wasted.

BRIEF SUMMARY OF THE INVENTION

An embodiment of the disclosure meets the needs presented above by generally comprising a bottom wall having a top side, a bottom side and a perimeter edge. The perimeter wall has a rectangular shape and the bottom wall has a length and width each is between 40.0 inches and 60.0 inches. A perimeter wall is attached to and extends upwardly from the perimeter edge. The perimeter wall includes a front wall, a rear wall, a first lateral wall and a second lateral wall. The top side of the bottom wall has a pair of raised sections extending from the front wall to the back wall. The raised sections form forklift slots in a concrete block formed by the bottom and perimeter walls. The raised sections are oriented parallel to each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
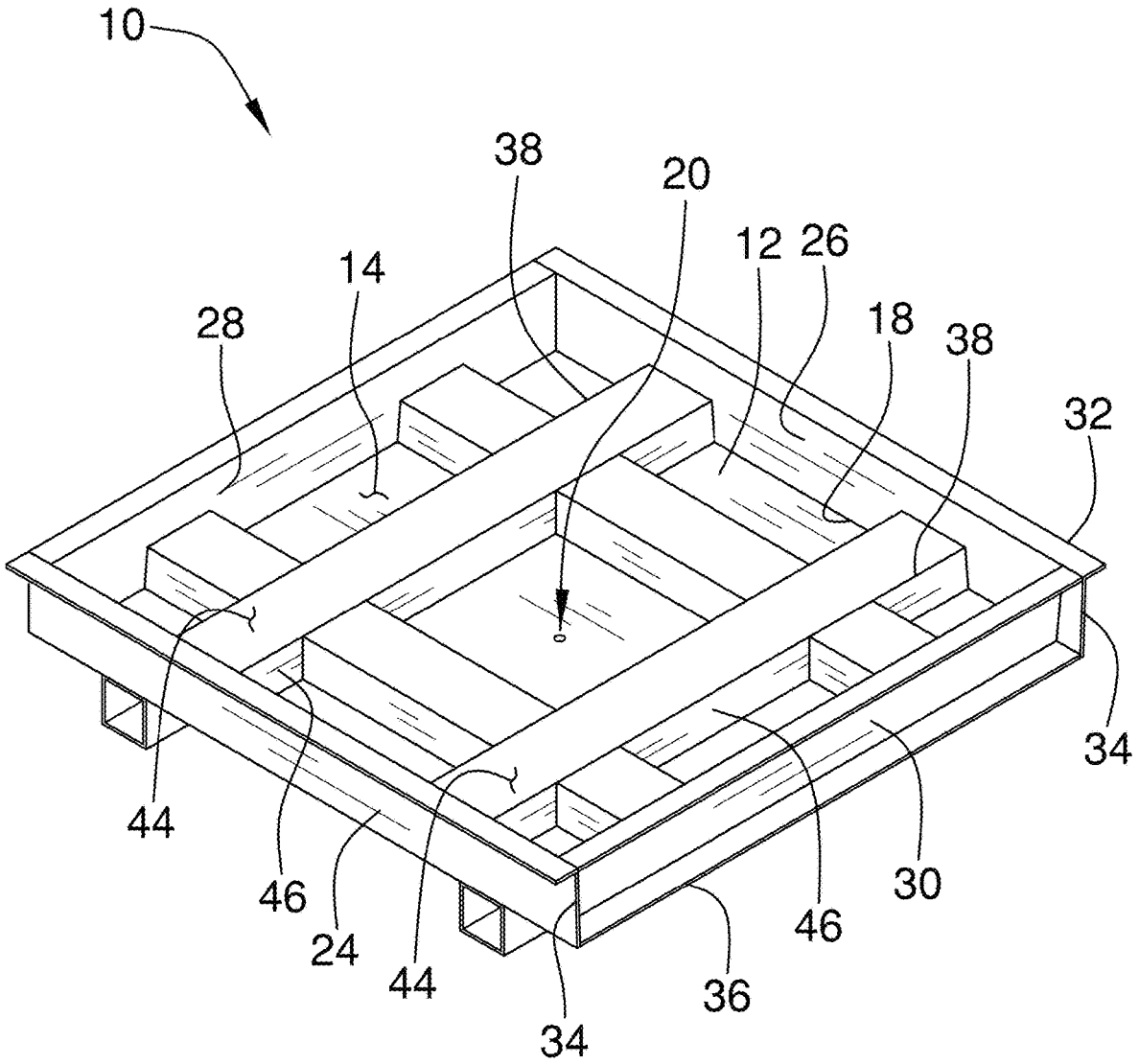
FIG. 1 is a top isometric view of a pallet forming concrete mold assembly according to an embodiment of the disclosure.

With reference now to the drawings, and in particular to FIGS. 1 through 8 thereof, a new waste concrete mold form embodying the principles and concepts of an embodiment of the disclosure and generally designated by the reference numeral 10 will be described.

Figure 2:
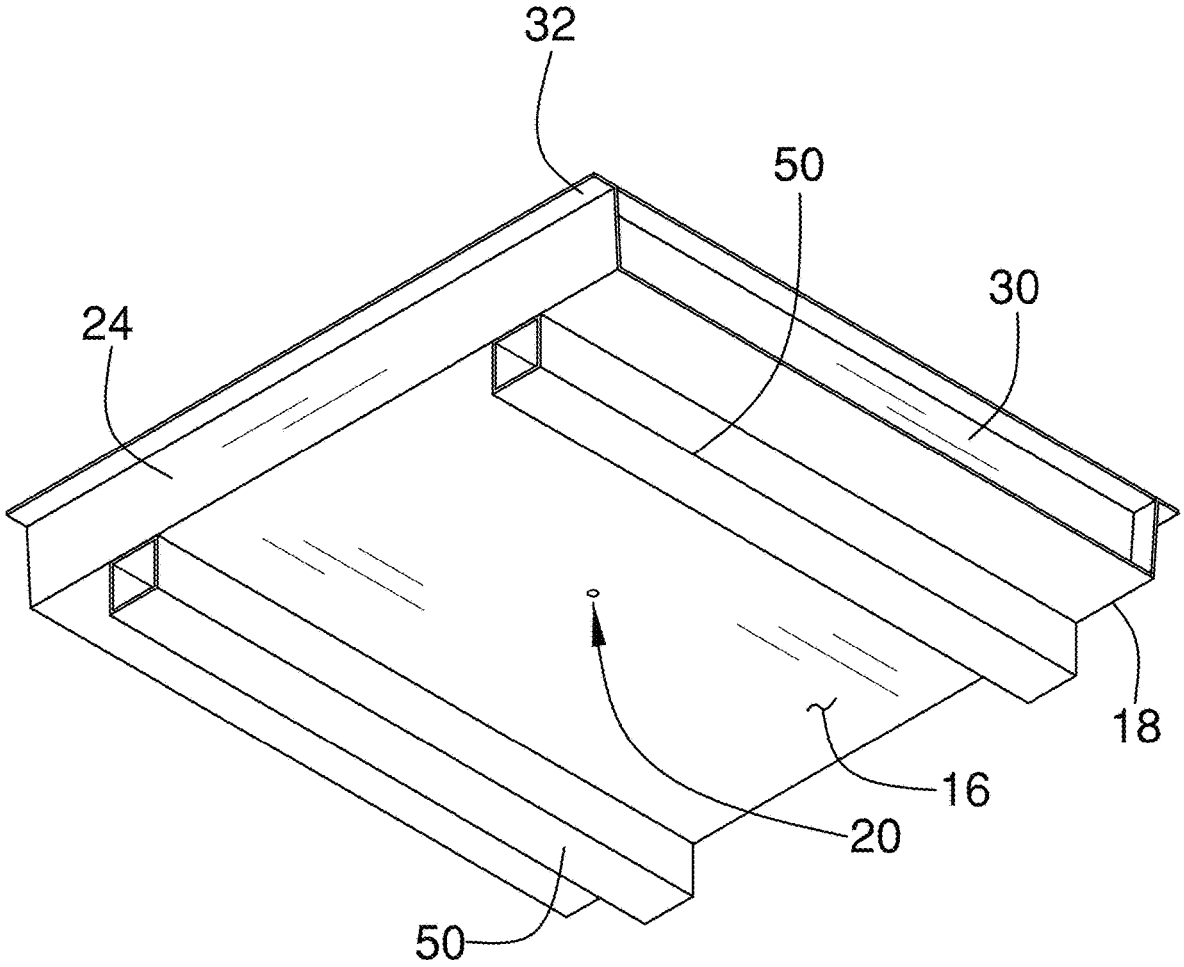
FIG. 2 is a bottom isometric view of an embodiment of the disclosure.
Figure 3:
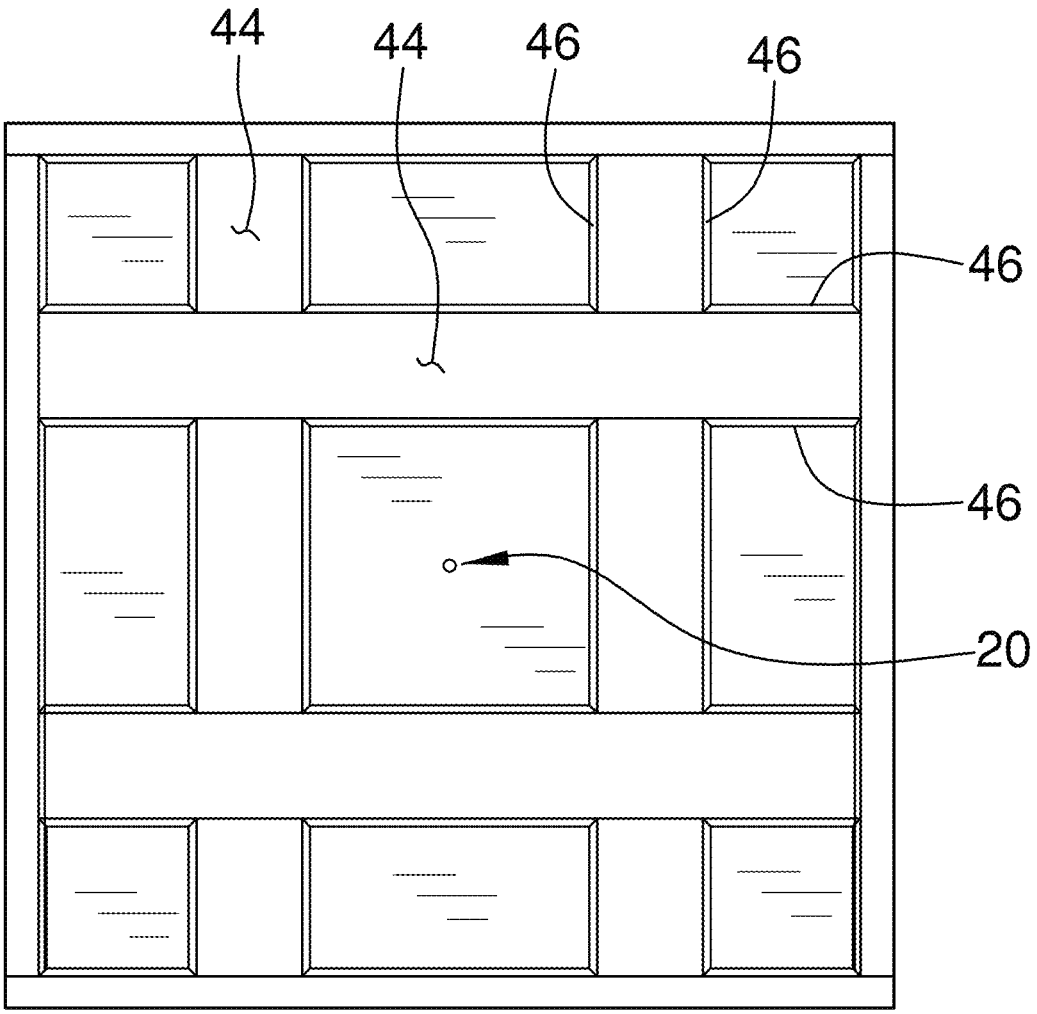
FIG. 3 is a top view of an embodiment of the disclosure.
Figure 4:
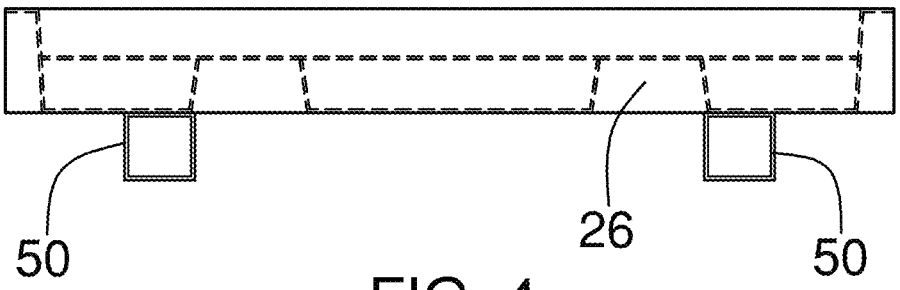
FIG. 4 is a rear view of an embodiment of the disclosure.
Figure 5:
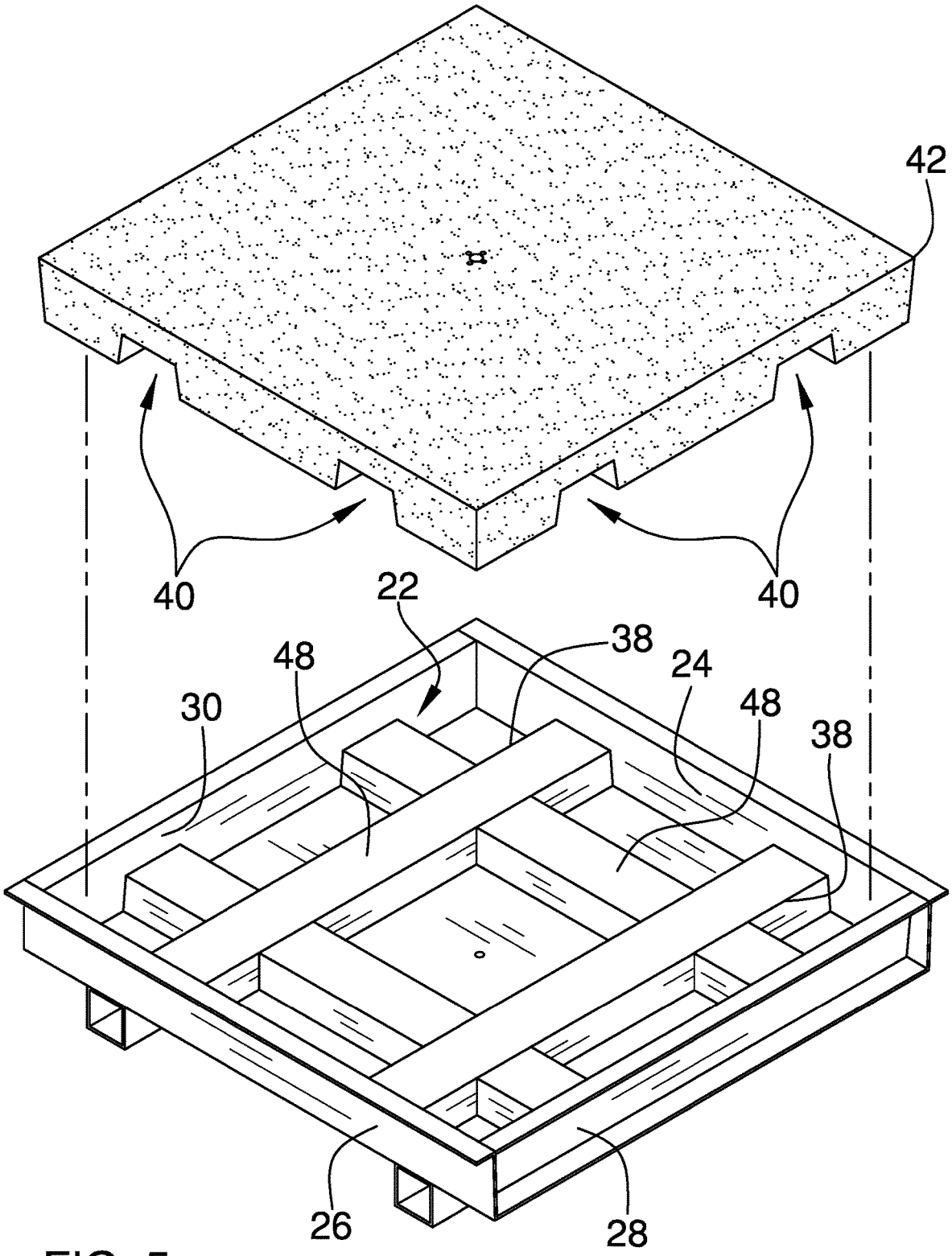
FIG. 5 is a top, rear isometric view of an embodiment of the disclosure.
Figure 6:
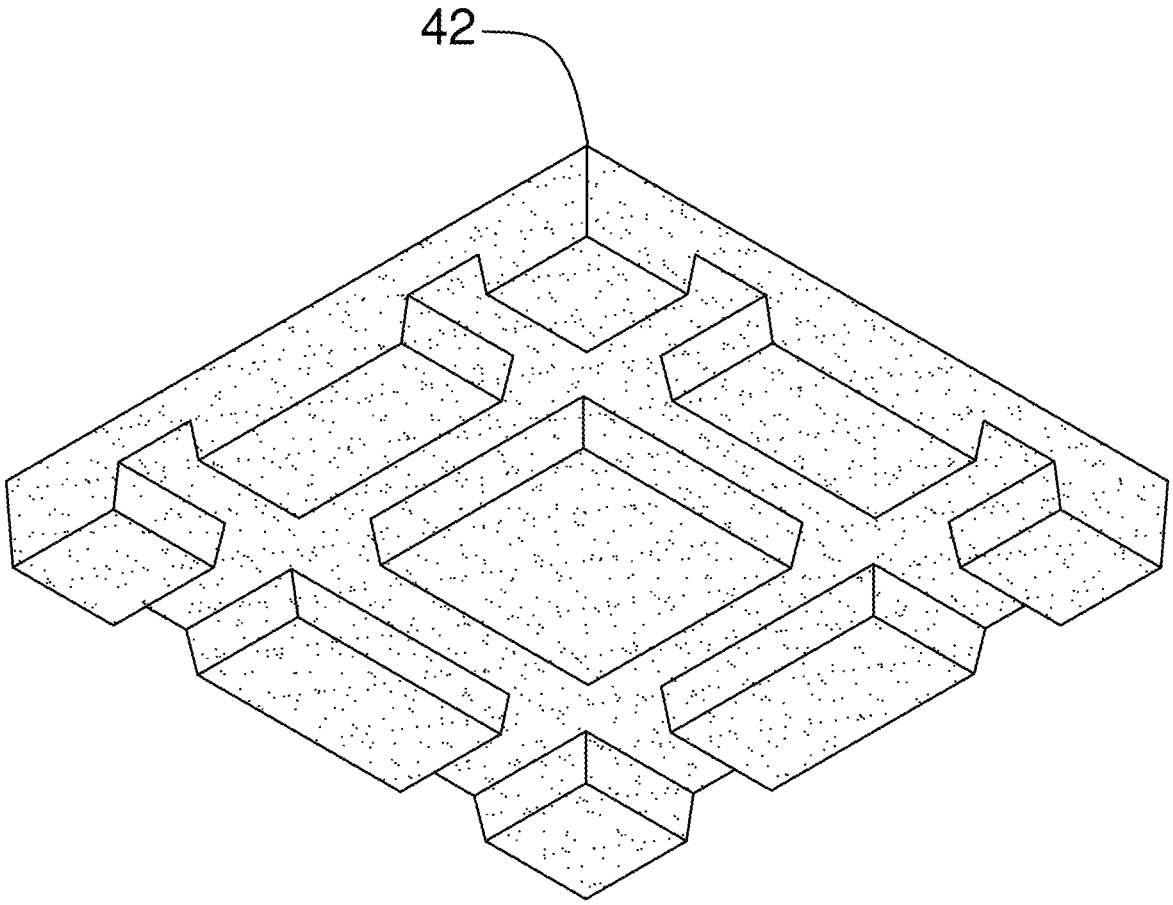
FIG. 6 is a bottom isometric view of a block of an embodiment of the disclosure.
Figure 7:
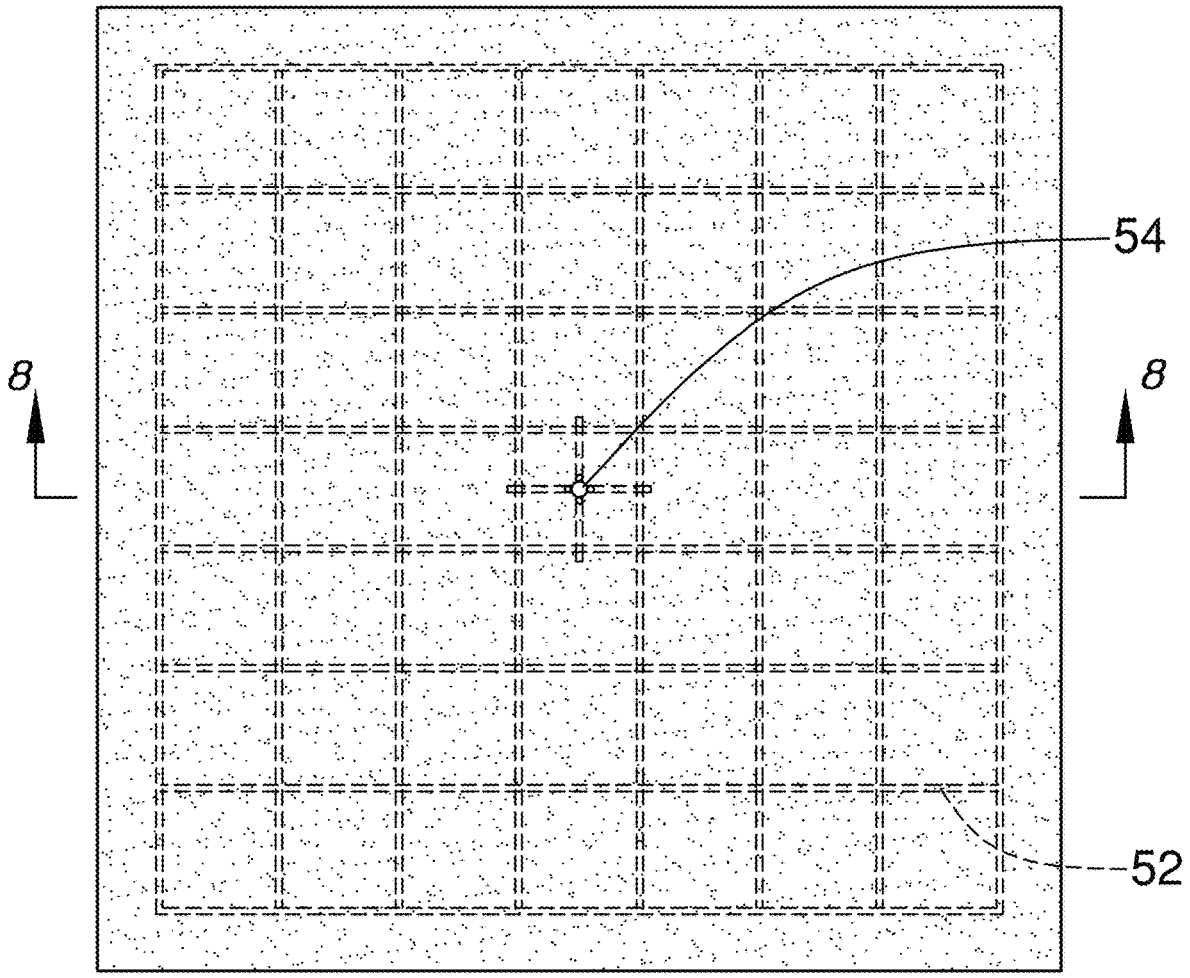
FIG. 7 is a top view of the block of an embodiment of the disclosure.

As best illustrated in FIGS. 1 through 8, the pallet forming concrete mold assembly 10 generally comprises a device to utilize waste concrete that remains after a particular concrete pouring task has been completed. The assembly 10 includes a bottom wall 12 that has a top side 14, a bottom side 16 and a perimeter edge 18. The perimeter edge 18 has a rectangular shape and the bottom wall 12 has a length and width each being between 40.0 inches and 60.0 inches. Typically the bottom wall 12 will have a substantially square shape and having a length and width equal to about 48.0 inches. The bottom wall 12 may include a centrally located air release aperture 20 that is centrally located in the bottom wall 12. As can be seen in FIGS. 2 and 4, the bottom wall 12 may be formed with an inner layer and an outer layer such that an outer housing receives an inner housing, wherein the inner layer forms the contours of a form and the outer layer provides a planar base.

A perimeter wall 22 is attached to and extends upwardly from the perimeter edge 18. The perimeter wall 22 includes a front wall 24, a rear wall 26, a first lateral wall 28 and a second lateral wall 30. The perimeter wall 22 may form an acute angle with respect to the top side 14, wherein the acute angle is greater than 75° and will more typically be greater than 80°. The perimeter wall 22 has a height between 5.0 inches and 8.0 inches. An upper flange 32 may be attached to and be co-extensive with an upper edge of the perimeter wall 22. Lateral flanges 34 may extend from the front 24 and rear 26 walls which join the upper flange and bottom flanges 36 extending outwardly from lower edges of the first 28 and second 30 lateral walls. The various flanges 32, 34, 36 enhance the structural integrity of the assembly 10.

The top side 14 of the bottom wall 12 has a pair of raised sections 38 extending from the front wall 24 to the back wall 26. The raised sections 38 form forklift slots 40 in a concrete block 42 that is ultimately formed from the assembly 10 to facilitate movement of the concrete block 42 so that it may be used as a pallet. The raised sections 38 are oriented parallel to each other and each includes an upper surface 44 and a pair of lateral surfaces 46. The upper surfaces 44 may each be planar and lie in a horizontal plane as is shown in the Figures. The raised sections 38 have a height between 2.5 inches and 4.0 inches with respect to the top side 14 of the bottom wall 12. The lateral surfaces 46 of each of the raised sections 38 may be angled outwardly from a respective one of the upper surfaces 44 to the top side 14. An angle between the lateral surfaces 46 and the top side 14 will typically be between 90° and 100°.

Figure 8:
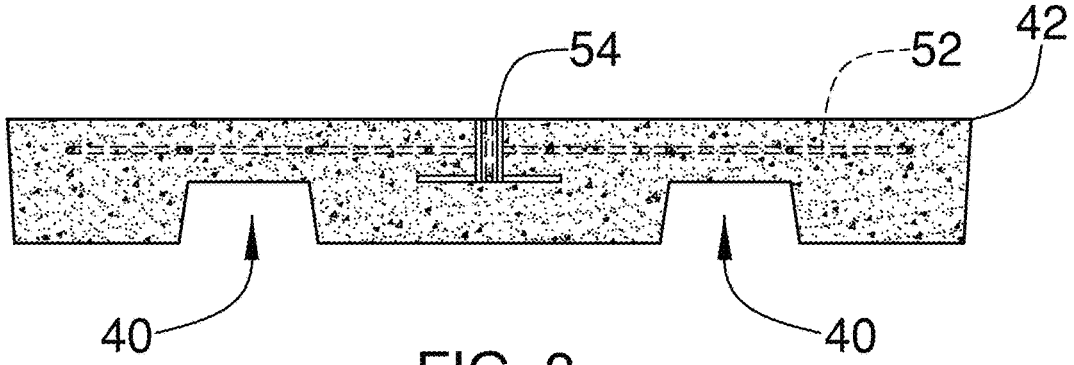
FIG. 8 is a front view of the block of an embodiment of the disclosure.

The raised sections 38 are spaced from each other a distance between 12.0 inches and 21.0 inches, with a more common distance of between 15.0 inches and 20.0 inches. Each of the raised sections 38 has a greatest width, measured between corresponding lateral walls 46, that is between 5.0 inches and 10.0 inches. A width of the upper surfaces 44 is between about 4.0 inches and 7.5 inches. The raised sections 38 are spaced from the first 28 and second 30 lateral walls. A space between the raised sections 38 and an adjacent one of the first 28 and second 30 lateral walls is between 4.0 inches and 8.0 inches. As can be seen in FIG. 8, these spatial relationships provide the locations for the forks of a fork lift as well as creating "legs" in the resultant block 42 for usage as a pallet.

The top side 14 of the bottom wall 12 has a pair of elevated sections 48 extending from the first lateral wall 28 to the second lateral wall 30. The elevated sections 48 form additional forklift slots 40 in the concrete block. The elevated sections 48 are parallel to each other and perpendicular to the raised sections 38. As can be seen in the Figures, the elevated sections 48 have generally a same size and shape as the raised sections 38 such that an upper surface 44 of the elevated sections 48 are coplanar with the upper surface 44 of the raised sections 38. The elevated sections 48 allow the blocks 42 to be engaged with the forks from a direction perpendicular and lateral to the raised sections 38.

A plurality of foots members 50 is attached to and extends downwardly from the bottom side 16 of the mold assembly 10. The foot members 50 have a height between 3.0 inches and 6.0 inches. The foot members 50 may include a pair of tubes extending from a front side to the back side and are spaced outside of the raised sections 38 such that the tubes are abutting the bottom side 16 of the bottom wall 12 from the front wall 24 to the back wall 26, When forks are positioned under the bottom wall 12, the tubes form outer barriers as well as lift the bottom wall 12 off of the ground to facilitate access thereof.

In use, the mold assembly 10 is filled with concrete such that the concrete can set to form a block 42 as shown in FIGS. 5 through 8. Within the concrete will typically be positioned rebar 52 as well as a lift insert 54 that is used as a lifting point lifting the block 42 from the assembly 10. Once removed from the assembly 10, the block 42 may be used as a conventional pallet for supporting and transporting objects. Alternatively, multiple ones of the blocks 42 may be placed adjacent to each other in the ground to form large pavers for forming driveways, parking spaces and the like, particularly in industrial areas which would otherwise have dirt or gravel driveways. Because the mold assembly 10 is filled with waste cement, the cost of using the blocks 42 for pavers or pallets is very economical.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mold for forming a concrete pallet, the mold comprising:

a bottom wall having a top side, a bottom side and a perimeter edge, the perimeter edge having a rectangular shape, the bottom wall having a length and width each being between 40.0 inches and 60.0 inches;

a perimeter wall being attached to and extending upwardly from the perimeter edge, the perimeter wall including a front wall, a rear wall, a first lateral wall and a second lateral wall;

the top side of the bottom wall having a pair of raised sections extending from the front wall to the back wall, wherein the raised sections form forklift slots in a concrete block, the raised sections being oriented parallel to each other; and a plurality of foot members being attached to and extending downwardly from the bottom side of the bottom wall, said foot members being parallel and spaced farther apart than the raised sections wherein the foot members are configured to form outer barriers for a fork of a forklift when the fork is positioned under the bottom wall.

2. The mold for forming a concrete pallet according to claim 1, wherein the perimeter wall forms an acute angle with respect to the top side, the acute angle being greater than 75°.

3. The mold for forming a concrete pallet according to claim 1, wherein the perimeter wall has a height between 5.0 inches and 8.0 inches.

4. The mold for forming a concrete pallet according to claim 1, Wherein each of the raised sections include an upper surface and a pair of lateral surfaces, the upper surfaces each being planar and lying in a horizontal plane.

5. The mold for forming a concrete pallet according to claim 4, wherein the lateral surfaces of each of the raised sections are angled outwardly from a respective one of the upper surfaces to the top side.

6. The mold for forming a concrete pallet according to claim 1, wherein the raised sections having a height between 2.5 inches and 4.0 inches with respect to the top side.

7. The mold for forming a concrete pallet according to claim 6, wherein the raised sections being spaced from each other a distance between 12.0 inches and 21.0 inches, each of the raised sections having a greatest width measured between corresponding lateral walls being between 5.0 inches and 10.0 inches, a space between the raised sections and an adjacent one of the first and second lateral walls being between 4.0 inches and 8.0 inches.

8. The mold for forming a concrete pallet according to claim 7, wherein the top side of the bottom wall has a pair of elevated sections extending from the first lateral wall to the second lateral wall, wherein the elevated sections form forklift slots in the concrete block, the elevated sections being parallel to each other and perpendicular to the raised sections, the elevated sections having a same size and shape as the raised sections.

9. The mold for forming a concrete pallet according to claim 1, wherein the top side of the bottom wall has a pair of elevated sections extending from the first lateral wall to the second lateral wall, wherein the elevated sections form forklift slots in the concrete block, the elevated sections being parallel to each other and perpendicular to the raised sections, the elevated sections having a same size and shape as the raised sections.

10. The mold for forming a concrete pallet according to claim 1, wherein the foot members have a height between 3.0 inches and 6.0 inches.

11. A mold for forming a concrete pallet, the mold comprising:

a bottom wall having a top side, a bottom side and a perimeter edge, the perimeter edge having a rectangular shape, the bottom wall having a length and width each being between 40.0 inches and 60.0 inches;

a perimeter wall being attached to and extending upwardly from the perimeter edge, the perimeter wall including a front wall, a rear wall, a first lateral wall and a second lateral wall, the perimeter wall forming an acute angle with respect to the top side, the acute angle being greater than 75°, the perimeter wall having a height between 5.0 inches and 8.0 inches;

the top side of the bottom wall having a pair of raised sections extending from the front wall to the back wall, wherein the raised sections form forklift slots in a concrete block, the raised sections being oriented parallel to each other, each of the raised sections including an upper surface and a pair of lateral surfaces, the upper surfaces each being planar and lying in a horizontal plane, the raised sections having a height between 2.5 inches and 4.0 inches with respect to the top side, the lateral surfaces of each of the raised sections being angled outwardly from a respective one of the upper surfaces to the top side, the raised sections being spaced from each other a distance between 12.0 inches and 21.0 inches, each of the raised sections having a greatest width measured between corresponding lateral walls being between 5.0 inches and 10.0 inches, a space between the raised sections and an adjacent one of the first and second lateral walls being between 4.0 inches and 8.0 inches;

the top side of the bottom wall having a pair of elevated sections extending from the first lateral wall to the second lateral wall, wherein the elevated sections form forklift slots in the concrete block, the elevated sections being parallel to each other and perpendicular to the raised sections, the elevated sections having a same size and shape as the raised sections such that an upper surface of the elevated sections are coplanar with the upper surface of the raised sections; and a plurality of foot members being attached to and extending downwardly from the bottom side of the bottom wall, the foot members having a height between 3.0 inches and 6.0 inches, the foot members being parallel and spaced farther apart than the raised sections wherein the foot members are configured to form outer barriers for a fork of a forklift when the fork is positioned under the bottom wall.

* * * * *